US010815708B2

(12) United States Patent
Haeske et al.

(10) Patent No.: US 10,815,708 B2
(45) Date of Patent: Oct. 27, 2020

(54) POSITIONER MECHANISM USING LINEAR ADJUSTING LOCK

(71) Applicants: Robert Lee Haeske, Milan, MI (US); Steve Lin, Northville, MI (US); Edward Poulos, Grosse Ile, MI (US); Richard T. Oliver, Noblesville, MI (US)

(72) Inventors: Robert Lee Haeske, Milan, MI (US); Steve Lin, Northville, MI (US); Edward Poulos, Grosse Ile, MI (US); Richard T. Oliver, Noblesville, MI (US)

(73) Assignee: Porter Systems, Novi, MI (US)

( * ) Notice: Subject to any disclaimer, the term of this patent is extended or adjusted under 35 U.S.C. 154(b) by 692 days.

(21) Appl. No.: 15/642,385

(22) Filed: Jul. 6, 2017

(65) Prior Publication Data

US 2019/0010740 A1 Jan. 10, 2019

(51) Int. Cl.
*E05C 17/20* (2006.01)
*E05C 17/00* (2006.01)
(Continued)

(52) U.S. Cl.
CPC ..... *E05C 17/203* (2013.01); *E05B 53/005* (2013.01); *E05C 17/003* (2013.01); *E05C 19/003* (2013.01); *E05C 17/28* (2013.01); *Y10S 292/51* (2013.01); *Y10T 292/03* (2015.04); *Y10T 292/28* (2015.04); *Y10T 292/285* (2015.04); *Y10T 292/286* (2015.04);
(Continued)

(58) Field of Classification Search
CPC ..... Y10T 292/28; Y10T 292/285; Y10T 292/286; Y10T 292/03; Y10T 292/65; Y10T 292/67; Y10T 292/299; E05B 53/005; E05C 17/203; E05C 17/003; E05C 17/28; E05C 19/003; Y10S 292/51; E05F 5/00; E05F 5/12
USPC ..... 49/394; 296/146.1, 146.11; 16/82, 85, 16/86 C; 267/166, 179
See application file for complete search history.

(56) References Cited

U.S. PATENT DOCUMENTS 654,723 A * 7/1900 Franks ..... E05C 17/22 292/262
706,217 A * 8/1902 Busch ..... E06B 3/2605 49/67
(Continued)

*Primary Examiner* — Kristina R Fulton
*Assistant Examiner* — Faria F Ahmad
(74) *Attorney, Agent, or Firm* — Heed Law Group PLLC; Thomas P Heed

(57) ABSTRACT

The present invention is a positioning mechanism device to prevent the motion of one surface with respect to a second surface, in one direction. The positioning mechanism uses a linear adjusting lock, an actuator, and an over-ride mechanism. The linear adjusting lock uses a coil spring to hold a rod in place. When firmly coiled, the coil spring is able to grip a smooth rod and prevent axial motion. When the coil spring is uncoiled, slightly, it releases its grip on the smooth rod, allowing axial motion. The positioner mechanism uses an actuator and release blade to release the coil spring. Additionally, the over-ride mechanism can be used to release the release blade in one direction without use of the actuator. When the coil spring is released by either the actuator or over-ride mechanism the two surfaces can be re-positioned relative to one another.

20 Claims, 17 Drawing Sheets

(51) Int. Cl.
*E05C 19/00* (2006.01)
*E05B 53/00* (2006.01)
*E05C 17/28* (2006.01)

(52) U.S. Cl.
CPC ..... *Y10T 292/299* (2015.04); *Y10T 292/65* (2015.04); *Y10T 292/67* (2015.04)

(56) References Cited

U.S. PATENT DOCUMENTS 786,532 A * 4/1905 Stumpf ..... E05C 17/22 292/262
791,669 A * 6/1905 Brandon ..... E05B 5/003 292/1
794,807 A * 7/1905 Linder ..... E04F 10/0603 160/75
1,126,969 A * 2/1915 Foerster ..... E05C 17/166 292/270
1,358,349 A * 11/1920 Waters ..... E05C 17/20 292/265
1,533,879 A * 4/1925 Macinnes ..... E05F 11/00 292/262
1,539,856 A * 6/1925 Martin ..... E05C 17/30 292/262
1,691,332 A * 11/1928 Beuc ..... E05C 17/30 292/275
1,763,238 A * 6/1930 Hubbs ..... E05C 17/30 292/262
1,880,711 A * 10/1932 Bittorf ..... E05C 17/22 292/262
1,898,742 A * 2/1933 Phillips ..... F21V 17/168 24/270
1,905,921 A * 4/1933 Litchfield ..... E05F 13/00 49/346
1,918,652 A * 7/1933 Marbach ..... E05C 17/203 16/82
1,993,050 A * 3/1935 Cook ..... E05C 17/36 160/95
2,049,144 A * 7/1936 Wahlberg ..... G05G 5/18 74/543
2,104,172 A * 1/1938 Sibley ..... E05C 17/32 292/263
2,200,627 A * 5/1940 Levy ..... E05C 17/30 292/262
2,496,737 A * 2/1950 McCallick ..... E05B 5/003 292/1
2,683,446 A * 7/1954 Groff ..... F24C 15/023 126/191
2,724,609 A * 11/1955 Donnelly ..... E05C 17/30 292/266
2,756,082 A * 7/1956 Pucci ..... A47B 3/0912 403/107
2,779,069 A * 1/1957 Ziesmer ..... E05D 15/28 49/248
2,880,029 A * 3/1959 Allen ..... E05C 17/085 292/278
3,038,569 A * 6/1962 Knox ..... A62C 2/12 292/262
3,820,285 A * 6/1974 Shiffler et al. ..... E05B 65/0888 49/450
3,821,884 A * 7/1974 Walsh ..... E05B 65/0888 70/95
3,825,290 A * 7/1974 Messina ..... E05B 65/0888 292/262
3,851,908 A * 12/1974 Hester ..... E05F 1/1058 292/262
3,869,886 A * 3/1975 Diaz ..... E05C 17/04 70/93
3,989,291 A * 11/1976 Hucknall ..... E05C 17/20 292/262
4,006,926 A * 2/1977 Boreback ..... E05C 17/18 292/262
4,062,577 A * 12/1977 Butterfield ..... E05C 17/50 292/262
4,073,522 A * 2/1978 Tierney ..... E05B 65/0888 292/262
4,087,883 A * 5/1978 Amdal ..... E05C 17/30 16/82
4,124,240 A * 11/1978 Adelberg ..... E05C 17/042 248/351
4,181,334 A * 1/1980 Fusi ..... E05B 83/16 292/262
4,295,676 A * 10/1981 Smith ..... E05B 65/0888 292/262
4,322,103 A * 3/1982 Acton ..... E05C 17/047 292/262
4,357,731 A * 11/1982 Strauss ..... E05C 17/085 16/70
4,403,561 A * 9/1983 Schaeflern ..... D05B 29/02 112/237
4,461,502 A * 7/1984 Burgess ..... E05B 65/0888 292/262
4,491,355 A * 1/1985 Marinoni ..... E05C 17/34 292/263
4,627,590 A * 12/1986 Zeorlin ..... B64D 29/06 248/351
4,811,440 A * 3/1989 Scott ..... B25F 1/00 16/82
4,959,511 A * 9/1990 Lloyd ..... G01R 1/06788 178/19.01
4,970,997 A * 11/1990 Inoue ..... F01L 1/267 123/90.16
5,007,669 A * 4/1991 Pomerleau ..... E05B 17/0025 292/207
5,024,303 A * 6/1991 Kosloff ..... E05C 17/30 16/82
5,039,147 A * 8/1991 Moon ..... E05C 19/004 292/262
5,048,150 A * 9/1991 Guerin ..... E05C 17/20 16/49
5,238,213 A * 8/1993 Pool ..... E05C 17/047 248/352
5,474,037 A * 12/1995 Paul ..... F01L 1/185 123/90.16
5,540,467 A * 7/1996 Briffa ..... E05C 19/003 292/288
5,551,740 A * 9/1996 Lin ..... E05F 3/221 292/262
5,581,941 A * 12/1996 Sill ..... E04D 13/0357 49/246
5,862,570 A * 1/1999 Lezuch ..... E05C 17/085 16/82
5,951,071 A * 9/1999 Elliott ..... E05C 19/004 292/262
6,340,184 B1 * 1/2002 Kuzmich ..... E05B 65/0888 292/259 R
6,343,818 B1 * 2/2002 Kuramochi ..... E05C 17/166 16/65
6,370,732 B1 * 4/2002 Yezersky ..... E05C 17/203 16/82
6,926,266 B1 * 8/2005 Paul ..... F02P 3/02 267/174
7,162,983 B1 * 1/2007 Raghavan ..... F01L 13/0036 123/90.16
7,171,705 B1 * 2/2007 Hicks ..... A47K 3/003 292/262
7,370,855 B2 * 5/2008 Youd ..... F01L 1/462 267/179
7,784,772 B2 * 8/2010 Knopp ..... F16F 9/0218 267/175
8,052,129 B2 * 11/2011 Youd ..... F16F 13/02 267/179
8,191,692 B2 * 6/2012 Mori ..... F16F 9/585 188/284
8,210,230 B2 * 7/2012 Glasl ..... B60J 1/2033 160/313
8,573,619 B2 * 11/2013 Koide ..... F16F 1/122 280/124.141

(56) References Cited

U.S. PATENT DOCUMENTS 8,807,547 B2 * 8/2014 Jung ..... H01H 5/06 200/400
2002/0041101 A1 * 4/2002 Carey ..... E05B 65/1033 292/1
2003/0127886 A1 * 7/2003 Liu ..... A47C 4/04 297/35
2003/0173786 A1 * 9/2003 Miyagawa ..... E05B 79/20 292/262
2004/0251696 A1 * 12/2004 Murayama ..... E05C 17/203 292/262
2006/0009317 A1 * 1/2006 Amy ..... E05C 19/10 473/502
2006/0082164 A1 * 4/2006 Shin ..... B62D 25/12 292/262
2007/0040392 A1 * 2/2007 Matsuki ..... E05C 17/206 292/262
2007/0085351 A1 * 4/2007 Erskine ..... B63B 19/14 292/262
2008/0042449 A1 * 2/2008 Yamaguchi ..... E05C 17/30 292/152
2008/0127684 A1 * 6/2008 Rudduck ..... E05B 47/0046 70/77
2008/0189907 A1 * 8/2008 Carter ..... E05F 1/1292 16/66
2009/0212578 A1 * 8/2009 Gibbons ..... E05B 65/0852 292/262
2009/0260409 A1 * 10/2009 Lee ..... E05B 47/0002 70/278.7
2012/0217762 A1 * 8/2012 Bruce ..... E05C 17/042 292/251.5
2013/0074412 A1 * 3/2013 Wellborn ..... E05C 17/203 49/381
2013/0257089 A1 * 10/2013 Minock ..... E05B 83/34 296/97.22
2013/0334828 A1 * 12/2013 Bruce ..... E05C 17/042 292/288
2016/0123044 A1 * 5/2016 Rosales ..... E05C 3/22 74/502.6

* cited by examiner

POSITIONER MECHANISM USING LINEAR ADJUSTING LOCK

FIELD OF INVENTION

This invention relates to the classification of miscellaneous hardware, and to one or more sub-classifications under spring-aided closure checks. Specifically, this invention is positioner mechanism using a linear adjusting lock.

BACKGROUND OF INVENTION

There are many situations in which an object needs to be moved into a position, and have that position maintained. Typically, the object to be moved is a large, hinged surface that needs to be re-positioned with respect to the structure to which it is hinged. Examples include car doors, trunks and hoods, as well as oven doors, dishwasher doors, and other large residential and commercial appliances and machinery. When such a surface is moved to a new position, it is often advantageous to lock it into position in either one or two directions. In other words, its advantageous, many times, to either prevent it from opening further or prevent it from shutting.

A car door provides an exemplary illustration of this problem. A car door is a surface which one would wish to remain in the position to which it was opened. With a few notable exceptions, the standard configuration of a motor vehicle cabin, and the doors on it, has remained relatively unchanged for over 100 years. Most motor vehicles have either two or four doors, excluding the trunk or rear hatchback. A conventional door is hinged at its forward edge, allowing its rearward edge to rotate outward from the vehicle side. Most vehicles have at least two conventional doors; one on the front driver-side and one on the front passenger-side. A vehicle may have more than two conventional doors. Typically, the cabin is accessed through an even number of doors placed symmetrically along the two sides of the vehicle, although some minivans and full-sized vans may have a single sliding door with or without an opposing conventional door. The utility of vehicle doors has changed dramatically over the last 100 years, as windows, window regulators, loudspeakers, electronic locks, sound dampening material, structural cross-members, and, of course, sliding van doors have been added.

Although vehicle doors may have electronic locks and other creature comforts, most articulating or conventional door mechanisms are largely manual with respect to door opening and closing, relying on the driver or other vehicle occupant to move the conventional door to the correct position for ingress and egress. Positioning a conventional door is a ubiquitous part of vehicle operation.

However, positioning the conventional door of a vehicle is often complicated in high wind conditions, or when the vehicle is parked on a hill. In high wind conditions, the wind can often pull a conventional door out of the user's hand. This can lead to damage to adjacent vehicles or structures; damage to the door surface, structure, or hinges; or injury to individuals in the path of the wind-blown door. Likewise, when parked on a hill, gravity can complicate ingress and egress, pulling the door out of the occupant's hand, and causing the damage listed above.

Currently, there is not a cheap and easy solution to this problem. The prior art is void of conventional door positioners designed to prevent an unexpected force, caused by the wind or gravity, from pulling the door out of the user's hand. As always with automotive hardware, considerations of weight, cost, and reliability are paramount.

SUMMARY OF THE INVENTION

This summary is intended to disclose the present invention, a positioner mechanism using a linear adjusting lock. The embodiments and descriptions are used to illustrate the invention and its utility, and are not intended to limit the invention or its use.

The present invention relates to using an over-ride mechanism in conjunction with a mechanical linear adjusting lock device, in order to prevent unwanted motion in one direction for a large, hinged surface. The embodiment discussed herein is an over-ride mechanism used with a single-spring linear adjusting lock in a vehicle door application, but the invention will work with a multi-spring linear adjusting lock of similar construction, as well with other large hinged surfaces. The linear adjusting lock comprises a rod, a notched annular bearing, a notched sleeve with a release blade, a housing, a coil spring, and a bushing. A cylinder with protrusions (hereinafter, the cylinder protrusions will be referred to as "trunnions", and the cylinder, itself, will be referred to as a "trunnion sleeve") mates the linear adjusting lock with an over-ride mechanism. The notched annular bearing, notched sleeve with a release blade, housing, coil spring, bushing, and trunnion sleeve all fit over the rod.

In this embodiment, a two-piece housing is used. The two-piece housing captures the notched annular bearing, notched sleeve with a release blade, coil spring, bushing, and trunnion sleeve, causing all of the elements to move in unison along the rod. For the sake of brevity, in this application, the notched annular bearing, notched sleeve with release blade, two-piece housing, coil spring, bushing, and trunnion sleeve are called the Axial Lock.

The rod has a rod hole at one end and a smooth, cylindrical opposing end over which the Axial Lock fits. The rod hole is connected to an anchor point. The trunnion sleeve's protruding trunnions mate with mating holes in the over-ride mechanism. The positioning mechanism, comprised of the Axial Lock and over-ride mechanism, has a mounting bracket. The invention will work with any housing wherein the linear adjusting lock is of similar construction.

The inner diameter of the coil spring is slightly smaller than the outer diameter of the rod. When firmly coiled, the coil spring is able to grip the smooth rod and prevent axial motion of the Axial Lock along the rod. When the coil spring is uncoiled, slightly, it releases its grip on the smooth rod, allowing axial motion of the Axial Lock along the length of the rod.

The coil spring is made of spring steel, or similar spring material, and has two protruding tangs. In this embodiment, the two protruding tangs are radially disposed at approximately a 90° angle from one another, although the radial angle between the tangs is largely immaterial. The notched sleeve is a cylinder with a flat blade extending orthogonally from its outer surface. The interior of the notched sleeve facing the coil spring has a ramp feature. The ramp feature is achieved by beveling the inner surface of the sleeve towards the cylinder end. The sleeve has a notch that mates with one of the tangs of the coil spring. The annular bearing also has a notch and a ramp feature. The notch of the annular bearing mates with the other tang of the coil spring.

When a tensile load is applied to the Axial Lock, the ramp feature inside the bearing causes the coil spring coils to tilt and grip the rod in proportion to the load. When a compressive load is applied to the Axial Lock, the ramp feature inside the sleeve with release blade causes the coil spring coils to tilt in the opposite orientation and grip the rod in proportion to the load. The Axial Lock device is unlocked by applying force to the sleeve blade, until the sleeve blade rotates through an acute angle. The coil spring is unwound, slightly, which causes the inner diameter of the coil spring to increase until there is a clearance between the coil spring and the rod. In this condition, the Axial Lock is free to move axially along the length of the rod to provide a re-positioning function. This allows the relative distance between the anchor and the mounting bracket to be adjusted by sliding the Axial Lock along the length of the rod. The Axial Lock is re-locked to the rod, in any position, by removing the force on the sleeve blade.

The over-ride system interoperates with the Axial Lock. The over-ride mechanism is comprised of an upper pivot link, a lower pivot link, a pivot pin, a lock rivet, a driven link, and assorted bushings, retaining clips, and fasteners. The over-ride mechanism is attached to the mounting bracket. The upper pivot link and the lower pivot link are identical in construction: The pivot links are constructed from steel or another durable material. The pivot links are largely planar with two rounded ends and a straight edge. The upper and lower pivot links each have three holes, spaced substantially in a line along the planar surface of the pivot links. The center hole in the upper pivot link mates with a trunnion on the trunnion sleeve. The center hole in the lower pivot link mates with another trunnion on the trunnion sleeve. The trunnions with which the upper pivot link and lower pivot link mate are opposed 180° from one another on the trunnion sleeve. The trunnions on the trunnion sleeve act as an axis of rotation for the upper and lower pivot link.

The mounting bracket has two pivot ears and two mounting ears, which are orthogonal to the pivot ears. The pivot pin passes through a hole in the upper pivot ear of the mounting bracket, a hole in the upper pivot link, a hole in the lower pivot link, and a hole in the lower pivot ear in the mounting bracket. The pivot pin locks the upper pivot link and lower pivot link together, so that they share the same rotation. The pivot pin also connects the mounting bracket to the pivot links. The upper pivot link and lower pivot link can rotate about the axis formed by their respective trunnions.

The driven link mates with a trunnion on the trunnion sleeve, which is orthogonal to the trunnions holding the upper and lower pivot links. The driven link can rotate about its trunnion, and is held against the trunnion by a retaining clip. The driven link has an engagement tab and an extension arm. The engagement tab is in contact with an engagement notch in the upper pivot link. The extension arm is in contact with the release blade. When the upper pivot link pivots, it exerts force on the engagement tab of the driven link, which causes the driven link to rotate about its trunnion. This causes the extension arm of the pivot link to apply force to the release blade and rotate it through a small acute angle, unlocking the Axial Lock. In this way, a small rotation of the pivot links unlocks the Axial Lock.

The lock rivet connects to a third hole in the upper pivot link and the lower pivot link. The lock rivet is semi-cylindrical with a flattened face. The flattened face engages with a flattened feature on the trunnion sleeve. The flattened face and flattened feature interact to prevent counter-rotation. In other words, the lock rivet functions to prevent the over-ride mechanism from rotating so that the engagement notch of the upper pivot link moves away from the engagement tab of the driven link.

In an automotive application, the positioner mechanism using a linear adjusting lock can be used to prevent the car door from traveling past desired position if the door is pulled from the user's hand due to high-wind conditions or gravity. In this application, the interior and exterior handles are connected to an actuator. The actuator can be a simple mechanical connection, or it can be an electrical actuator. When the user uses the door release handles the actuator activates the release blade and the car door is free to swing in either rotational direction. When the user releases the door handle, the actuator retracts and the release blade returns to its nominal position, causing the Axial Lock to lock the door from rotating further open. The lock rivet locks when the door is caught by the wind, preventing the over-ride mechanism from engaging. When the user pushes the door from the outside, or pulls from the inside, to close the door, the over-ride mechanism of the positioner mechanism rotates the release blade through an acute angle, unlocking the Axial Lock and allowing the door to close.

BRIEF DESCRIPTION OF THE DRAWINGS

The present invention is illustrated with 17 drawings on 17 sheets.

FIG. 13 B is an end view of the present invention, rotated 180° with respect to FIG. 13 A.

DETAILED DESCRIPTION OF THE DRAWINGS

The following descriptions are not meant to limit the invention, but rather to add to the summary of invention, and illustrate the present invention, by offering and illustrating various embodiments of the present invention, a positioner mechanism using linear adjusting lock. While embodiments of the invention are illustrated and described, the embodiments herein do not represent all possible forms of the invention. Rather, the descriptions, illustrations, and embodiments are intended to teach and inform without limiting the scope of the invention.

Figure 15:
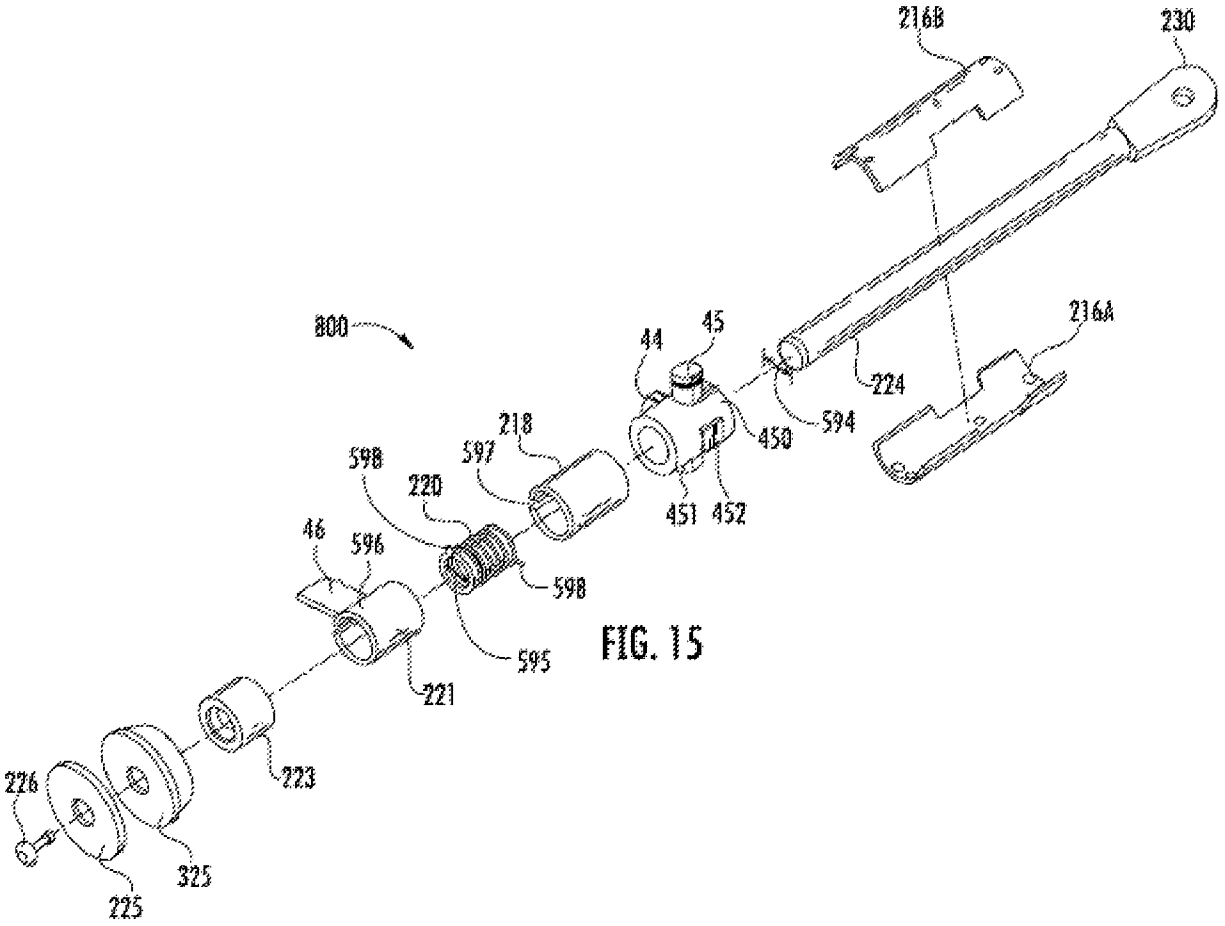
FIG. 15 is an exploded perspective isolation of the Axial Lock.

FIG. 15 shows the Axial Lock 800 that is embedded within the present invention. The Axial Lock 800 is comprised of a trunnion sleeve 450, with three trunnions 44, 45, 451 and a flat feature 452; a two-piece housing 216A, 216B; a single coil spring 220 with tangs 598 on either end and an inner diameter 595; a notched sleeve 221 with a notch 596 and a release blade 46, a bushing 223 with a ramp feature, and a notched bearing 218 with a notch 597. The Axial Lock 800 fits over a rod 224 with an outer diameter 594 and an integral anchor hole 230. A stopper 325, a washer 225, and a threaded fastener 226 are fastened to the end of the rod 224, creating a stop for the Axial Lock 800. The two-piece housing 216A, 216B captures the notched annular bearing 218, notched sleeve 221 with a release blade 46, coil spring 220, bushing 223, and trunnion sleeve 450, causing all of the elements of the Axial Lock 800 to move, in unison, along the rod 224.

The inner diameter 595 of the coil spring 220 is slightly smaller than the outer diameter 594 of the rod 224. This locks the Axial Lock 800 in place. One tang 598 of the coil spring 220 fits into the notch 597 of the notched bearing 218 and the other tang 598 of the coil spring 220 fits into the notch 596 of the notched sleeve 221 with release blade 46. When the release blade 46 is rotated through an acute angle, it slightly unwinds the coil spring 220 allowing the Axial Lock 800 to move, in unison, with respect to the rod 224.

Figure 11:
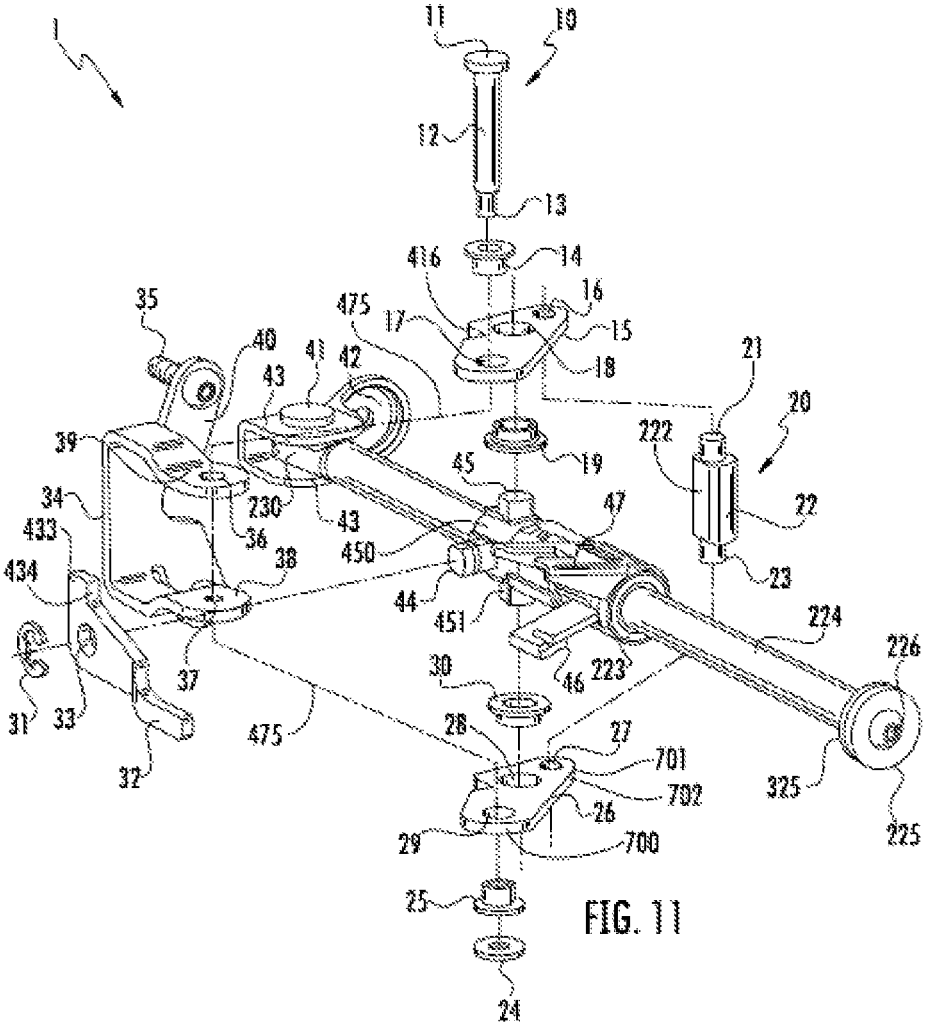
FIG. 11 is an exploded perspective view of the present invention.

FIG. 11 is an exploded view of the positioner mechanism using a linear adjusting lock 1. Exterior portions of the Axial Lock 800 are still visible: the trunnion sleeve 450 and three trunnions 44, 45, 451; the release blade 46, and the bushing 223. The rod 224 with integral anchor hole 230 and the stop, composed of the stopper 325, washer 225, and threaded fastener 226, are also visible.

The positioner 1 uses a pivot pin 10, a mounting bracket 34, an upper pivot link 15, and a lower pivot link 26. The pivot links are identical planar members with two rounded ends 700, 701 separated by a straight edge 702. The upper pivot link 15 has an engagement notch 416 and three holes: 16, 17, 18. The lower pivot link 26 has three holes: 27, 28, 29. The upper pivot link has a center hole 18 and two outer holes 16, 17. The lower pivot link has a center hole 28 and two outer holes 27, 29. The engagement notch 416 is closer to one outer hole 17 than the other outer hole 16. In this embodiment, the holes 16, 17, 18, 27, 28, 29 of the pivot links 15, 26 are arranged substantially in a line running parallel to the straight edge 702, although this in not a requirement of the invention. One pivot hole 27 is near one rounded end 701. Another hole 29 is near the other rounded end 700. The last pivot hole 28 is between the other two pivot holes 27, 29.

The mounting bracket 34 has an upper pivot ear 39 with a hole 36; a lower pivot ear 38 with a hole 37; and two mounting tabs 40 through which threaded fasteners 35 fit. The pivot pin 10 has a head 11, a shank 12, and a nubbin 13. The pivot pin 10 fits through the hole 36 in the upper pivot ear 39 of the mounting bracket 34; an upper bushing 14; a hole 17 of the upper pivot link 15; a hole 29 in the lower pivot link 26; a lower bushing 25; the hole 37 in the lower pivot ear 38 of the mounting bracket 34; and a washer 24. Connector line 475 shows hole alignment, but not relative part orientation.

A trunnion 45 on the trunnion sleeve 450 of the Axial Lock 800 fits through a bushing 19 and the center hole 18 of the upper pivot link 15. A trunnion 451 on the trunnion sleeve 450 of the Axial Lock 800 fits through a bushing 30 and the center hole 28 of the lower pivot link 26.

A release anchor sleeve 47 is wrapped around the linear adjusting lock, aligning with the release blade 46.

A lock rivet 20 has a semi-cylindrical body 22 with a flattened surface 222, an upper nubbin 21, and a lower nubbin 23. The upper nubbin 21 fits in a hole 16 of the upper pivot link 15. The lower nubbin 23 fits in a hole 27 of the lower pivot link 26. The semi-cylindrical body 22 of the lock rivet 20 is oriented so that the flattened surface 222 faces the flattened feature 452 of the trunnion sleeve 450.

A driven link 433 has an extension arm 32, a pivot hole 33, and an engagement tab 434. The pivot hole 33 fits over a trunnion 44 on the trunnion sleeve 450, and is locked with a retaining clip 31. The driven link 433 can rotate about the trunnion 44. The extension arm 32 contacts the release blade 46. The engagement tab 434 contacts the engagement notch 416.

The integral anchor hole 230 of the rod 224 are connected to two retaining ears 43 with a hinge pin 41. There is an attachment ear 42 orthogonal to the two retaining ears 43.

Figure 1:
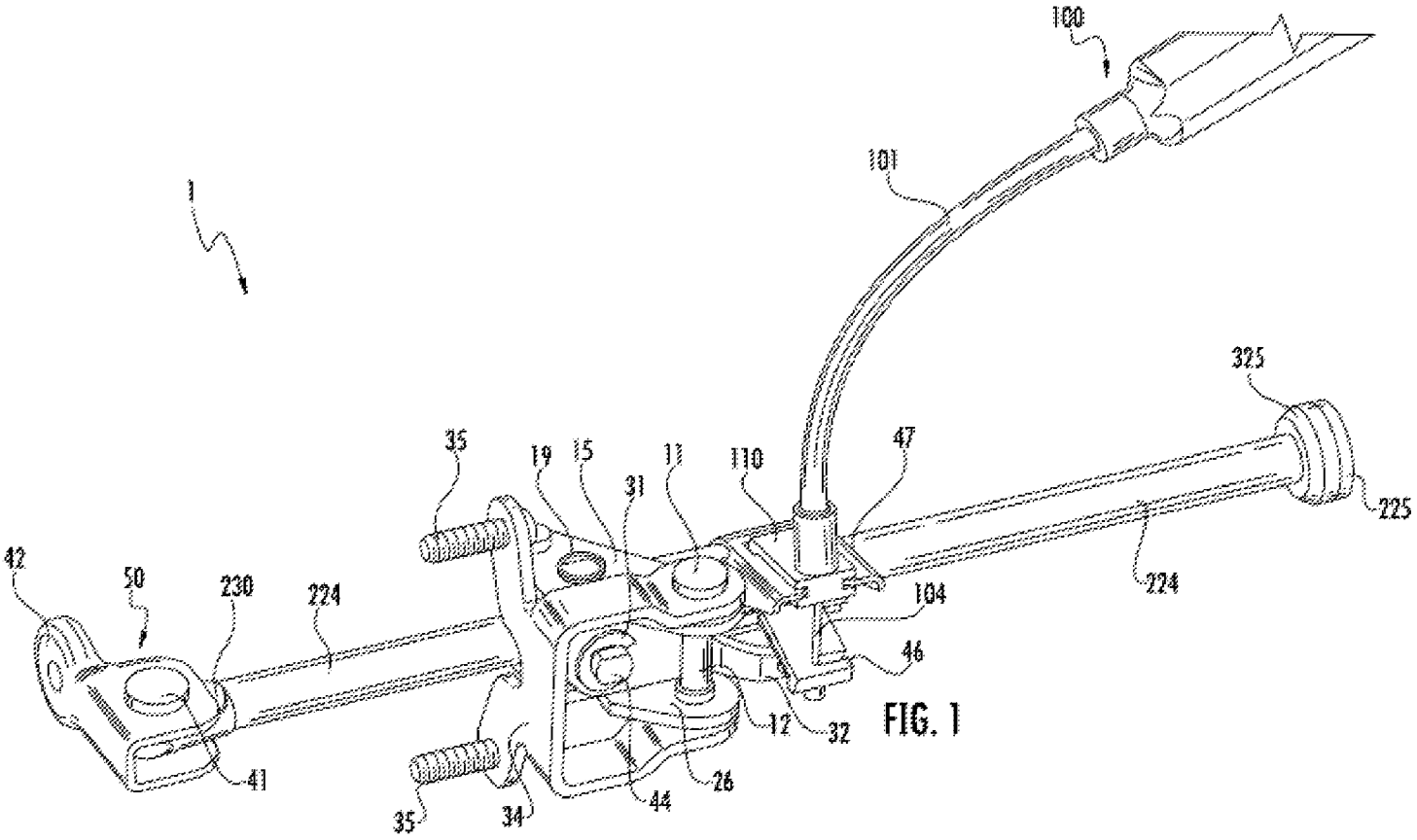
FIG. 1 is perspective drawing of the present invention, a positioner mechanism using an over-ride mechanism in conjunction with a mechanical linear adjusting lock.

FIG. 1 shows the positioner mechanism using linear adjusting lock 1. The integral anchor hole 230 of the rod 224 is connected to the rod anchor bracket 50. The rod anchor bracket 50 has an attachment ear with hole 42 orthogonal to a pair of retaining ears 43. The rod anchor bracket 50 attaches to the rod 224 at the integral anchor hole 230 with a hinge pin 41. Also visible in FIG. 1 are the mounting bracket 34 and fasteners 35; a trunnion 44 with retaining clip 31; a trunnion bushing 19; the upper 15 and lower pivot link 26; the pivot pin shank 12 and pivot pin head 11; the extension arm 32 of the driven link 433; the release blade 46; the release anchor sleeve 47; and stopper 325 and washer 225.

The release blade 46 of the linear adjusting lock is actuated by a release actuator 100 connected to a Bowden cable 101. The inner cable 104 of the Bowden cable 101 moves the release blade 46. The Bowden cable 101 is fixed to the release anchor sleeve 47 with a fitting 110.

Figure 7:
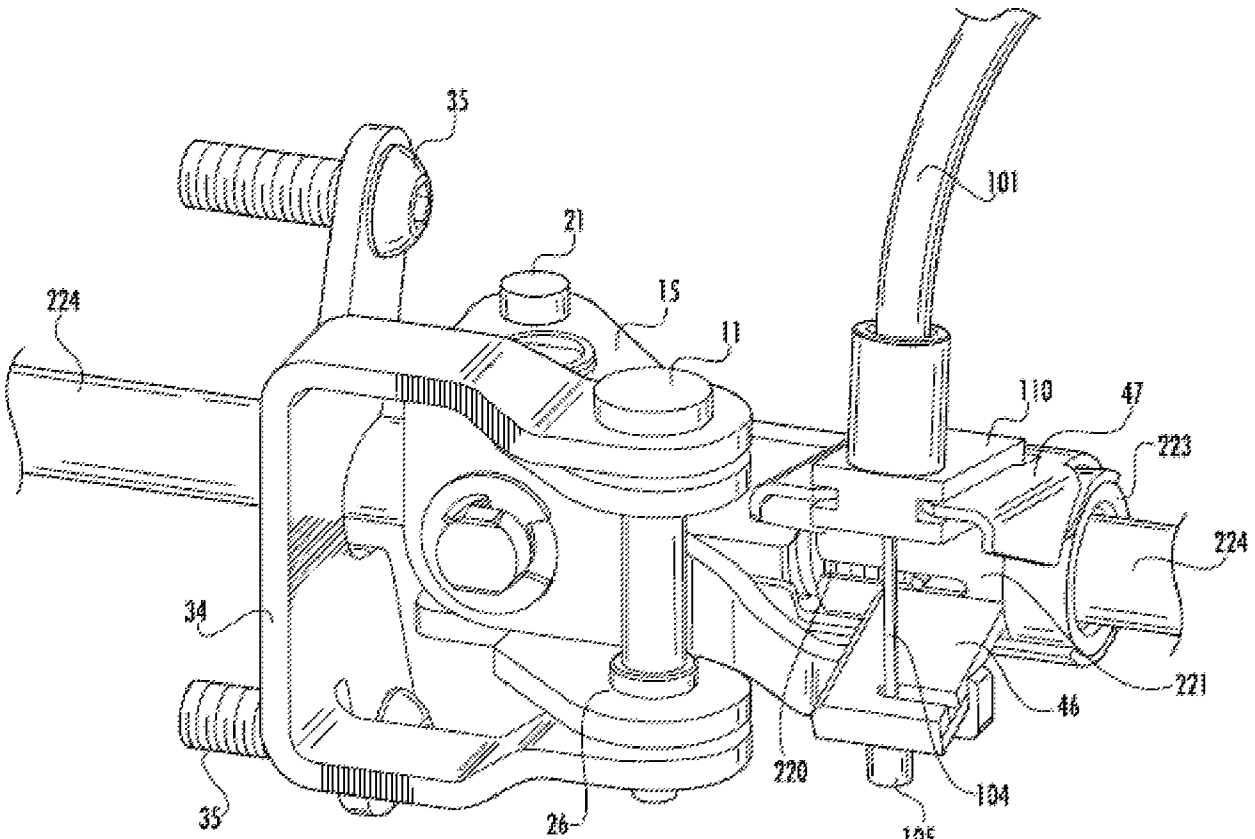
FIG. 7 is a close-up of the view of FIG. 1 of the present invention with a slight change in orientation.
Figure 8:
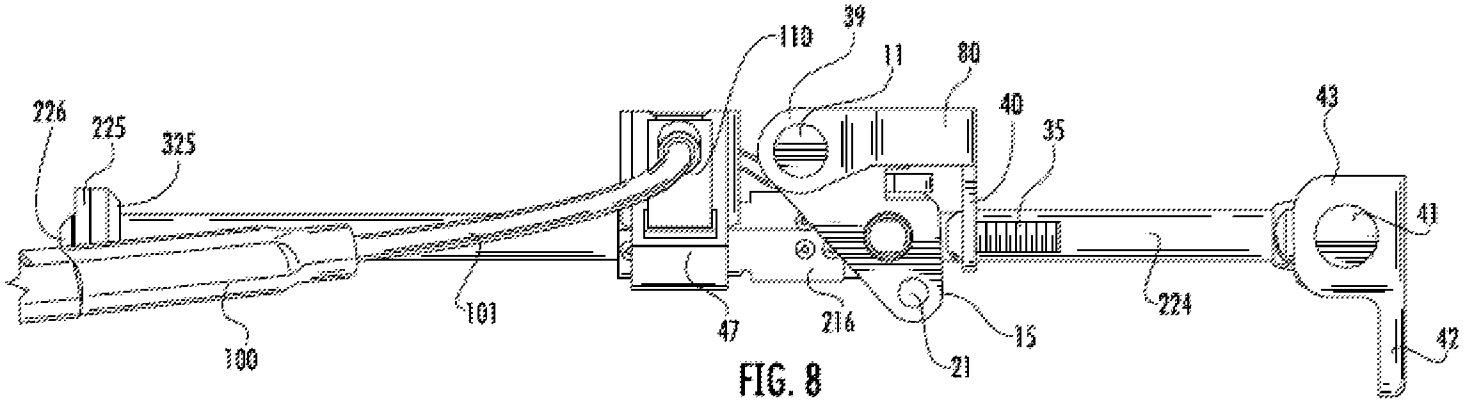
FIG. 8 is a top view of the present invention.

FIG. 7 is a close-up of FIG. 1, from a slightly different orientation. Similar to FIG. 1, the rod 224, the mounting bracket 34 and fasteners 35; the upper 15 and lower pivot link 26; and pivot pin head 11 are visible. Also visible in this view is the upper nubbin 21 of the lock rivet.

The interaction of the release mechanism is illustrated in this drawing. The Bowden cable 101 meets the release anchor sleeve 47 at a fitting 110. When the inner cable 104 is pulled, the Bowden cable termination nipple 105 rotates the notched sleeve 221 with release blade 46, opening the spring 220. This allows all of the parts 34, 35, 21, 15, 11, 26, 220, 105, 104, 46, 101, 110, 47, 223, 221 to move in unison with respect to the rod 224.

Figure 5:
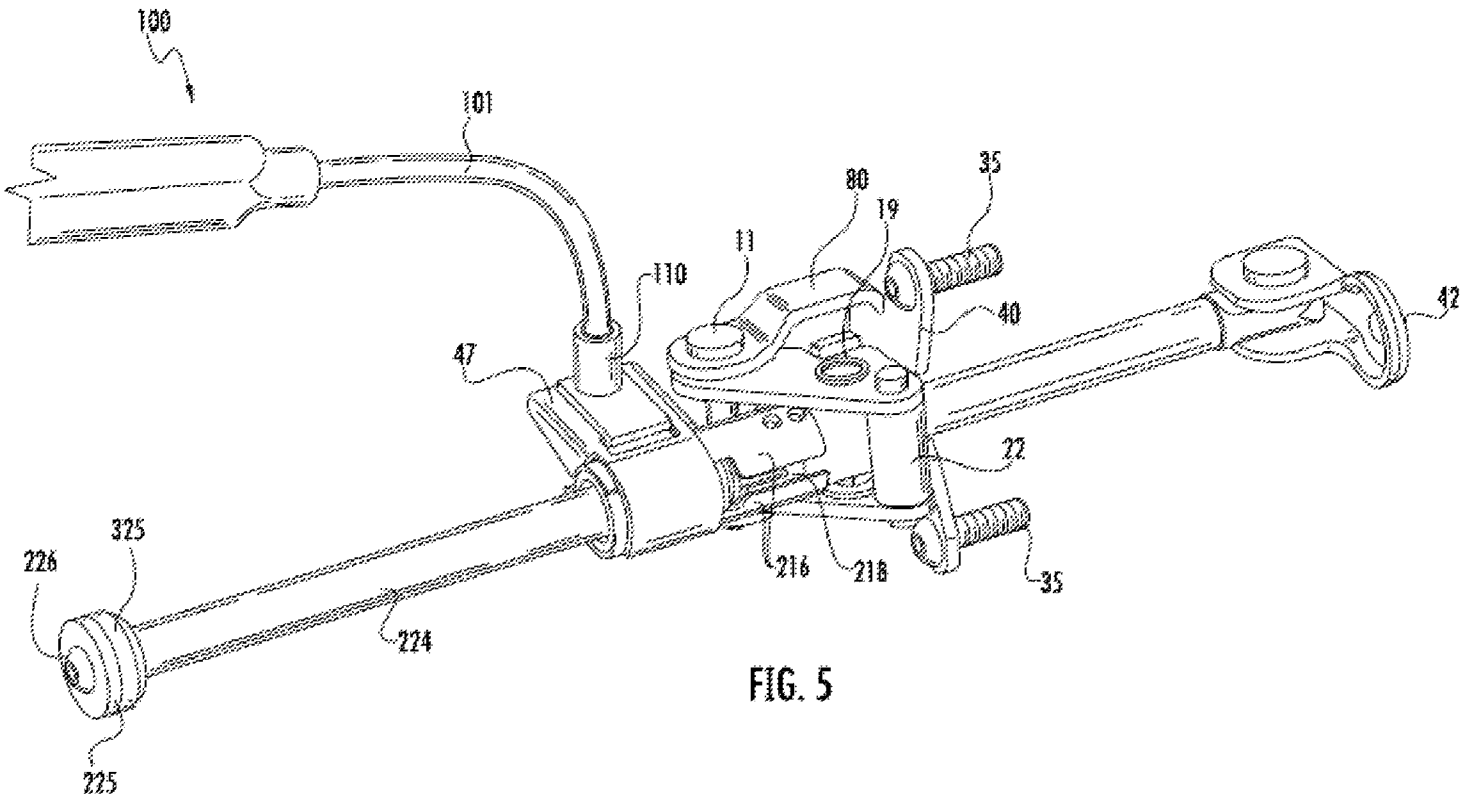
FIG. 5 is a perspective drawing of the present invention, rotated 180° with respect to FIG. 1.

FIG. 5 shows the present invention 1 rotated 180° from FIG. 1. From this view, the fastener 226, washer 225, and stopper 325 at the end of the rod 224 are visible. At the other end of the rod 224, the attachment ear 42 of the rod anchor bracket is visible. The release actuator 100, Bowden cable 101 and release anchor sleeve 47 are visible in this view, as is the Bowden cable 101 fitting 110. From this view, the semi-cylindrical body 22 of the lock rivet, the two-piece housing 216 of the Axial Lock, notched bearing 218, trunnion bushing 19, pivot pin head 11, mounting bracket mounting tab 40, and mounting bracket fasteners 35 are all visible. A bump 80 in the mounting bracket, designed to provide rotational clearance, is also visible.

Figure 6:
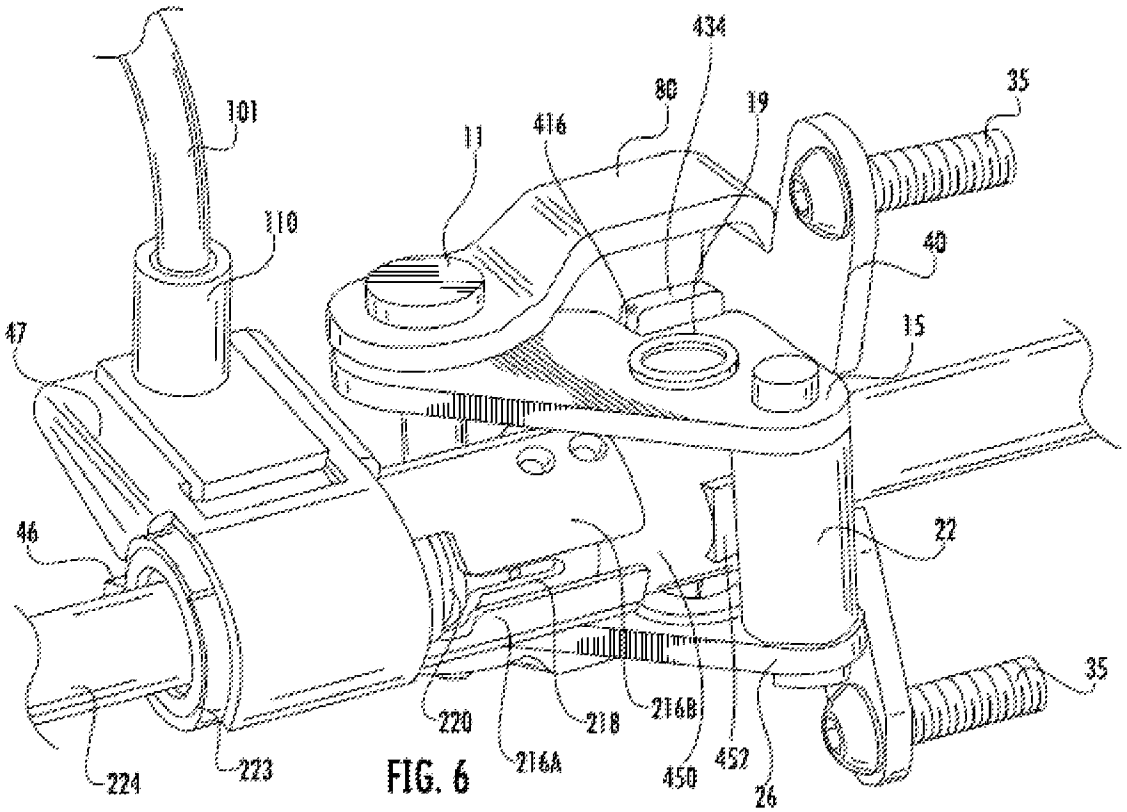
FIG. 6 is a close-up of the view of FIG. 5 of the present invention, with a slight change in orientation.

FIG. 6 is a close-up of the view in FIG. 5. In the close-up, important elements of the Axial Lock are visible: the trunnion sleeve 450, the flat feature 452 of the trunnion sleeve, the two-piece housing 216A, 216B, a single coil spring 220, the release blade 46, a bushing with a ramp feature 223, and a notched bearing 218. The rod 224, release anchor sleeve 47, Bowden cable 101, and the Bowden cable 101 fitting 110 are also visible in this view. From this view, the upper pivot link 15, lower pivot link 26, the semi-cylindrical body 22 of the lock rivet, trunnion bushing 19, pivot pin head 11, mounting bracket mounting tab 40, mounting bracket fasteners 35, and mounting bracket bump 80 are all visible. The engagement notch 416 of the upper pivot link 26, and engagement tab 434, are visible in this view.

FIGS. 8, 9, 12, and 14 are top, lateral, reverse lateral, and bottom views, respectively. In the top view, FIG. 8, the actuator 100, Bowden cable 101, fitting 110, stopper 325, washer 225, fastener 226, pivot pin head 11, lock rivet top nubbin 21, upper pivot link 15, mounting bracket bump 80, mounting bracket upper ear 39, release anchor sleeve 47, two-piece housing 216, mounting bracket mounting tab 40, mounting bracket fastener 35, rod 224, rod anchor bracket attachment ear 42, retaining ear 43, and hinge pin 41 are visible.

Figure 9:
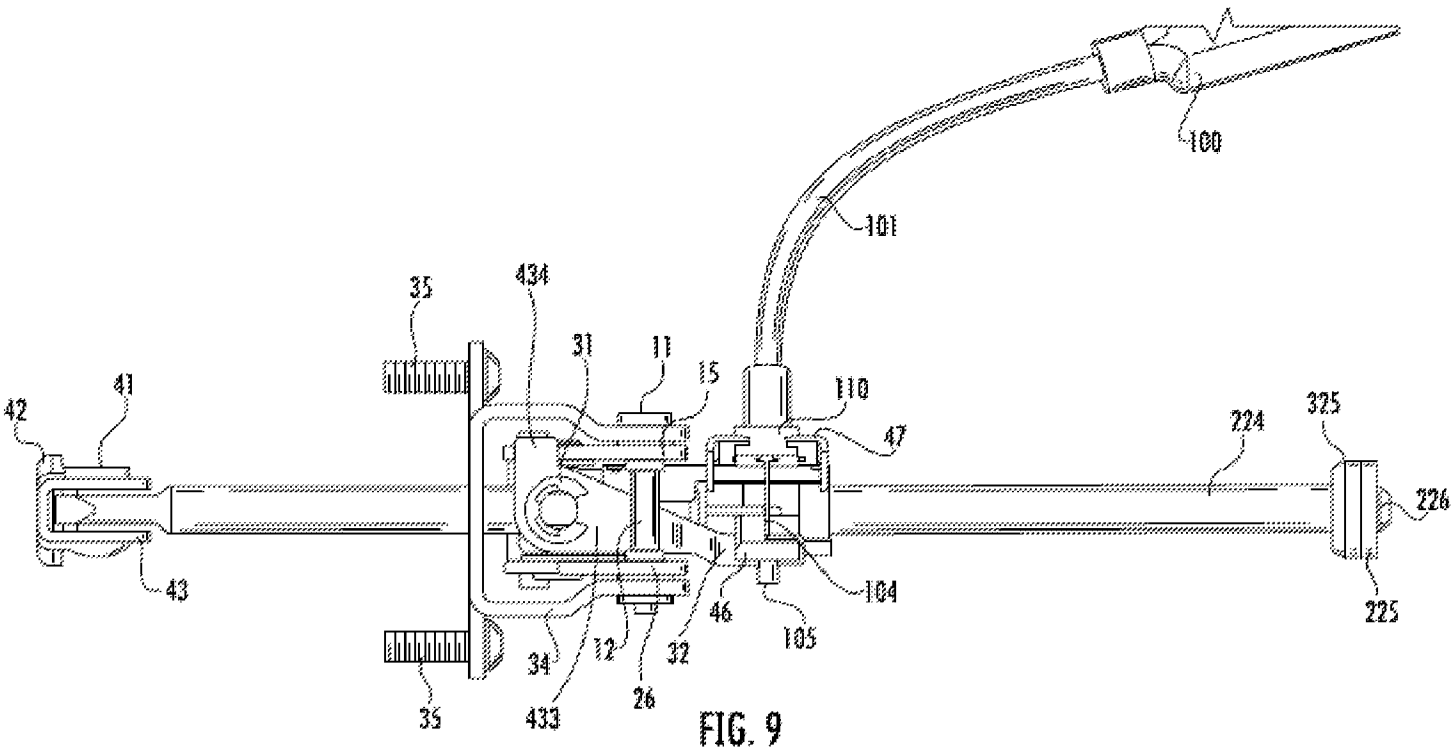
FIG. 9 is a lateral view of the present invention.

In the lateral view, FIG. 9, the actuator 100, Bowden cable 101, inner cable 104, termination nipple 105, fitting 110, stopper 325, washer 225, fastener 226, pivot pin head 11, pivot pin shank 12, upper pivot link 15, lower pivot link 26, mounting bracket 34, release anchor sleeve 47, release blade 46, mounting bracket fastener 35, rod 224, rod anchor bracket attachment ear 42, retaining ear 43, hinge pin 41, the extension arm 32 of the driven link 433, engagement tab 434, and retaining clip 31 are visible.

Figure 12:
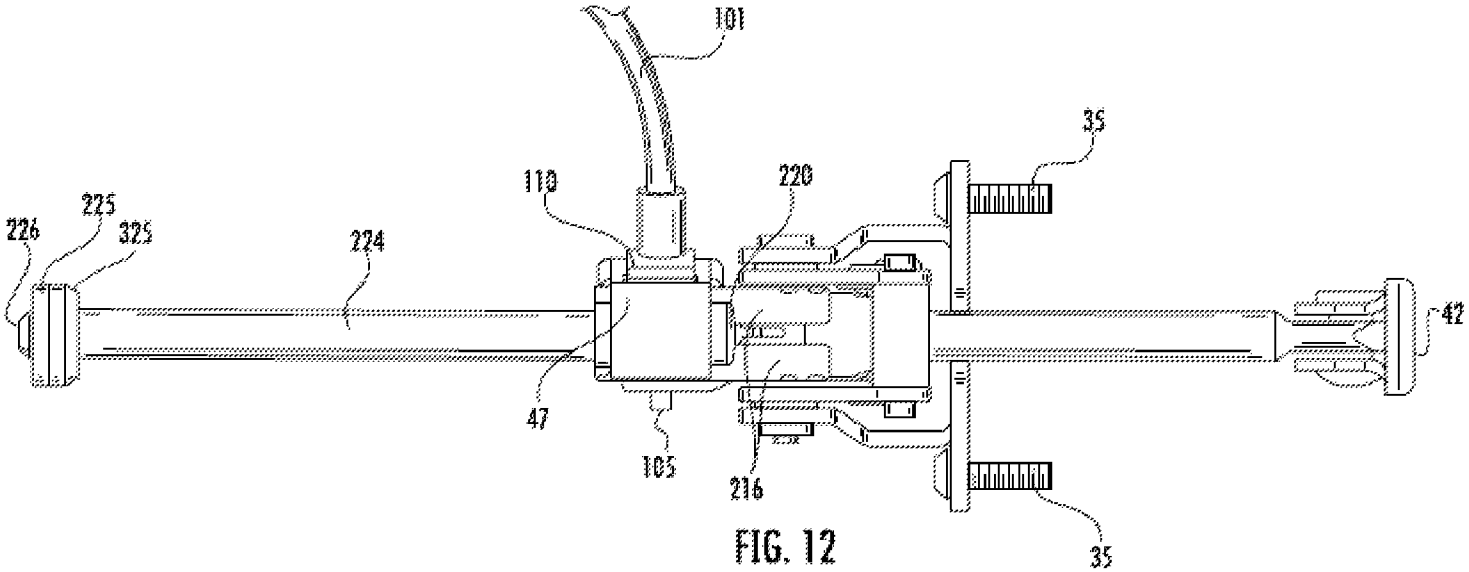
FIG. 12 is a lateral view of the present invention, rotated 180° with respect to FIG. 9.

In the reverse lateral view, FIG. 12, Bowden cable 101, termination nipple 105, fitting 110, stopper 325, washer 225, fastener 226, release anchor sleeve 47, rod 224, rod anchor bracket attachment ear 42, mounting bracket fastener 35, two-piece housing 216, and coil spring 220 are visible.

Figure 14:
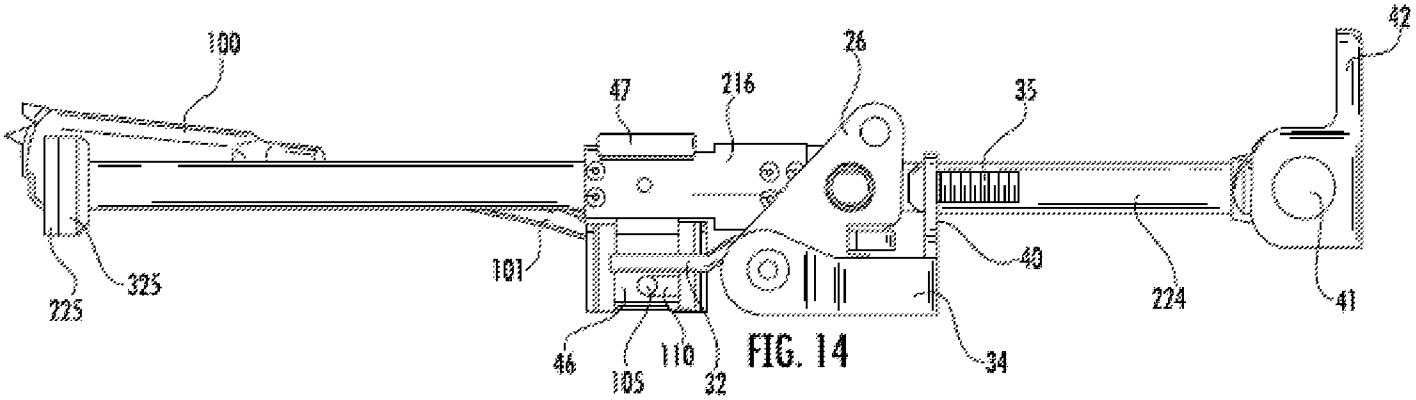
FIG. 14 is a bottom view of the present invention.

In the bottom view, FIG. 14, the actuator 100, Bowden cable 101, termination nipple 105, fitting 110, stopper 325, washer 225, two-piece housing 216, release blade 46, release anchor sleeve 47, mounting bracket fastener 35, mounting bracket 34, mounting bracket mounting tab 40, lower pivot link 26, rod 224, rod anchor bracket attachment ear 42, hinge pin 41, and the extension arm 32 are visible.

Figure 13A:
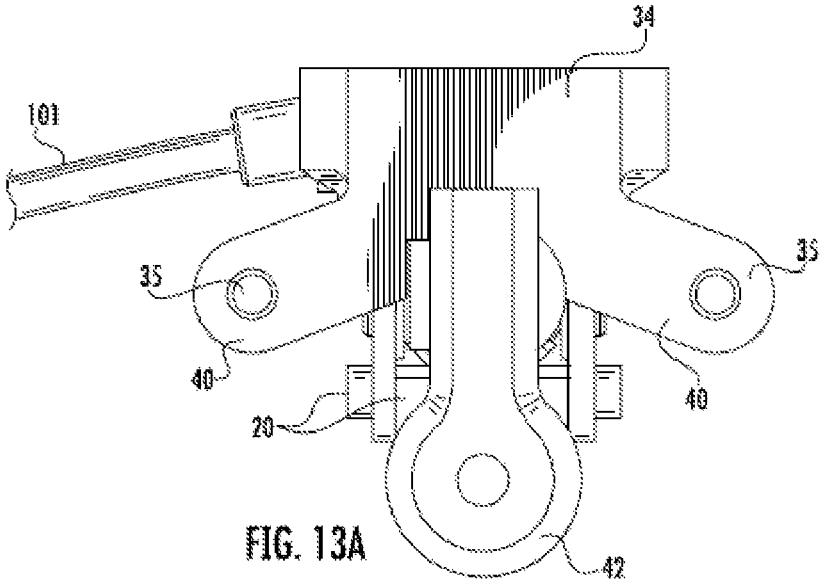
FIG. 13 A is an end view of the present invention.
Figure 13B:
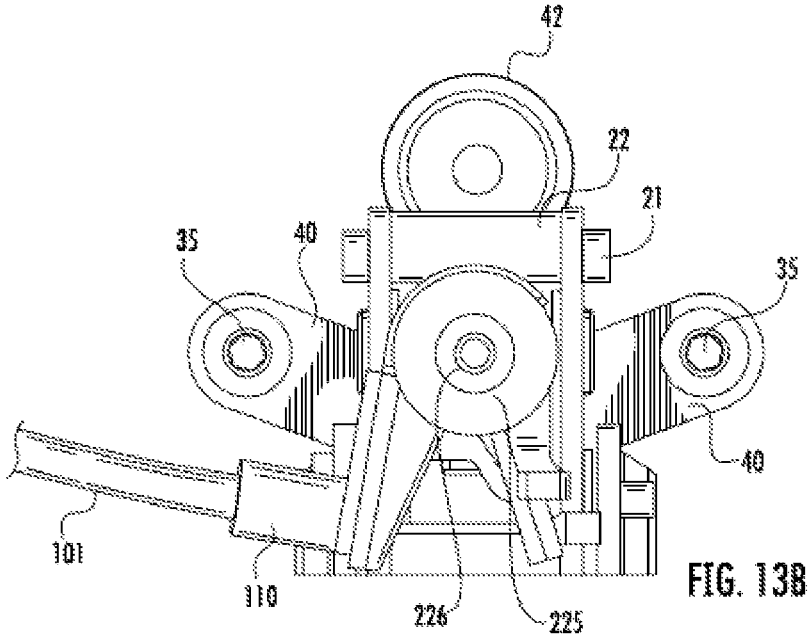

FIGS. 13A and 13B are end views of the present invention 1. In FIG. 13A, the rod anchor bracket attachment ear 42, mounting bracket 34, mounting bracket mounting tabs 40, bracket fasteners 35, Bowden cable 101, fitting 110, and lock rivet 20 are visible. In FIG. 13B, the stopper washer 225, fastener 226, the rod anchor bracket attachment ear 42, mounting bracket mounting tabs 40, bracket fasteners 35, Bowden cable 101, fitting 110, and lock rivet shank 22 are visible.

Figure 10:
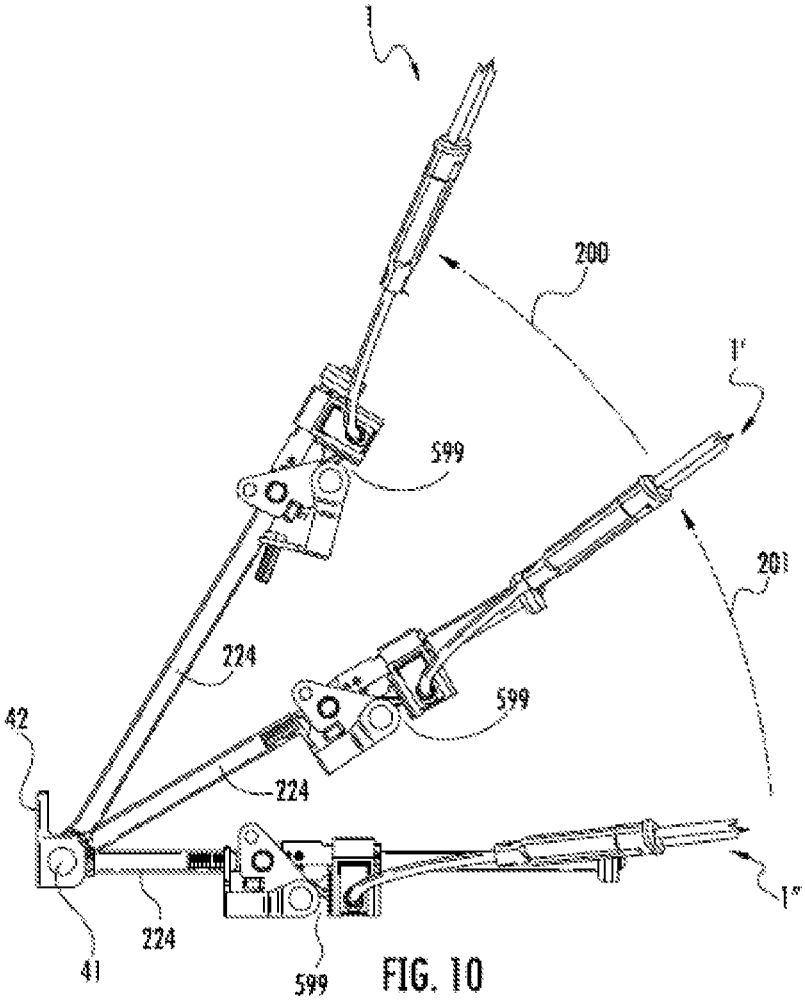
FIG. 10 is a top view of the present invention, rotated about its anchor point.

FIG. 10 shows the range of motion of the present invention 1, 1', 1", swinging 201 from a closed position 1" to an intermediate position 1'; and swinging further 200 from an intermediate position 1' to a fully opened position 1 A re-positioning aggregation 599 moves with respect to the rod 224. The re-positioning aggregation 599 is comprised of a trunnion sleeve 450, with three trunnions 44, 45, 451 and a flat feature 452; a two-piece housing 216A, 216B; a single coil spring 220; a notched sleeve 221 with release blade 46; a bushing with a ramp feature 223; a notched bearing 218; a stopper 325; the pivot pin 10; the mounting bracket 34; the upper pivot link 15; the lower pivot link 26; the lock rivet 20; the driven link 433 and retaining clip 31; and associated bushings, washers, and fasteners 24, 25, 30, 19, 14, 35.

When the present invention 1" is the closed position, the re-positioning aggregation 599 is closest to the rod anchor attachment ear 42. As the present invention 1' is opened 200 to an intermediate position, the re-positioning aggregation 599 is positioned further away from rod anchor attachment ear 42, rotating about the hinge 41. When the present invention 1 is in its fully opened position, the re-positioning aggregation 599 is furthest from the rod anchor attachment ear 42, rotating about the hinge 41

Figure 2:
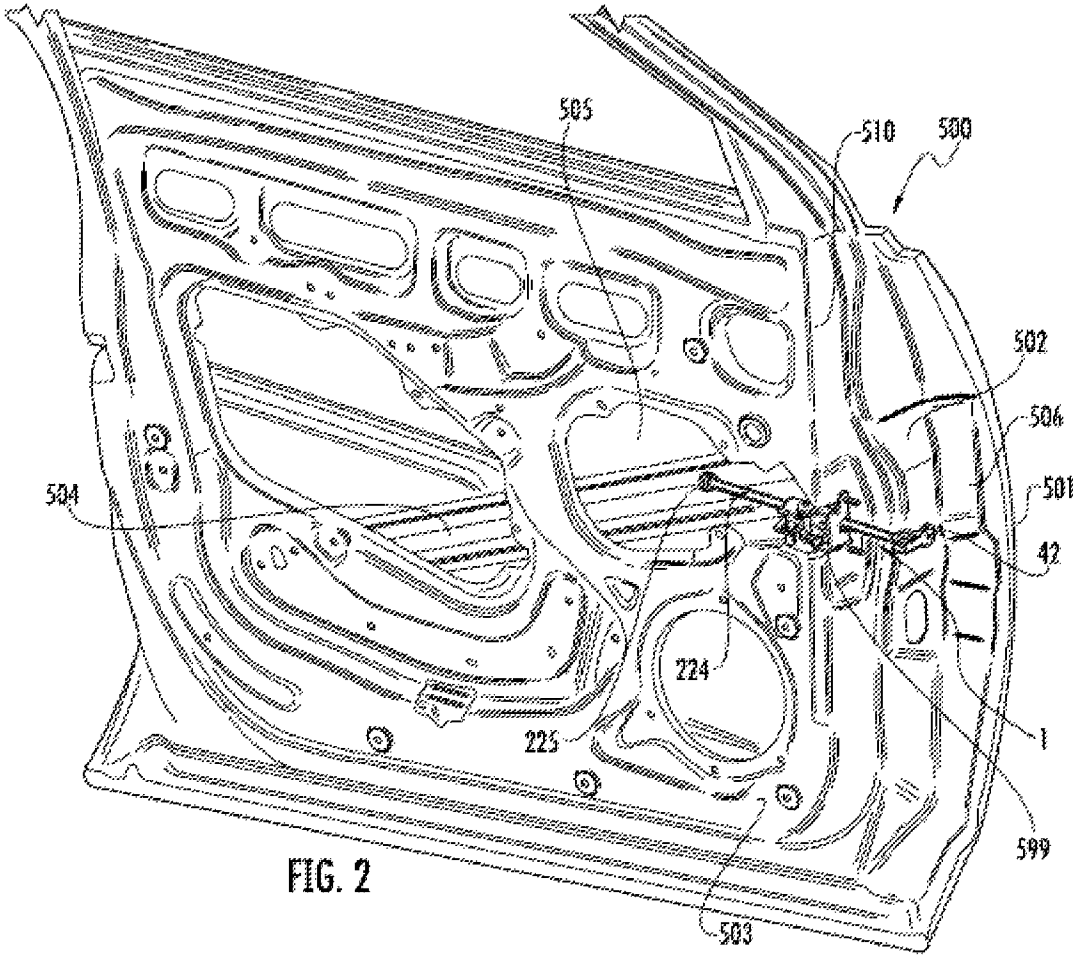
FIG. 2 is a perspective drawing of the present invention, in situ, in a car door.
Figure 3:
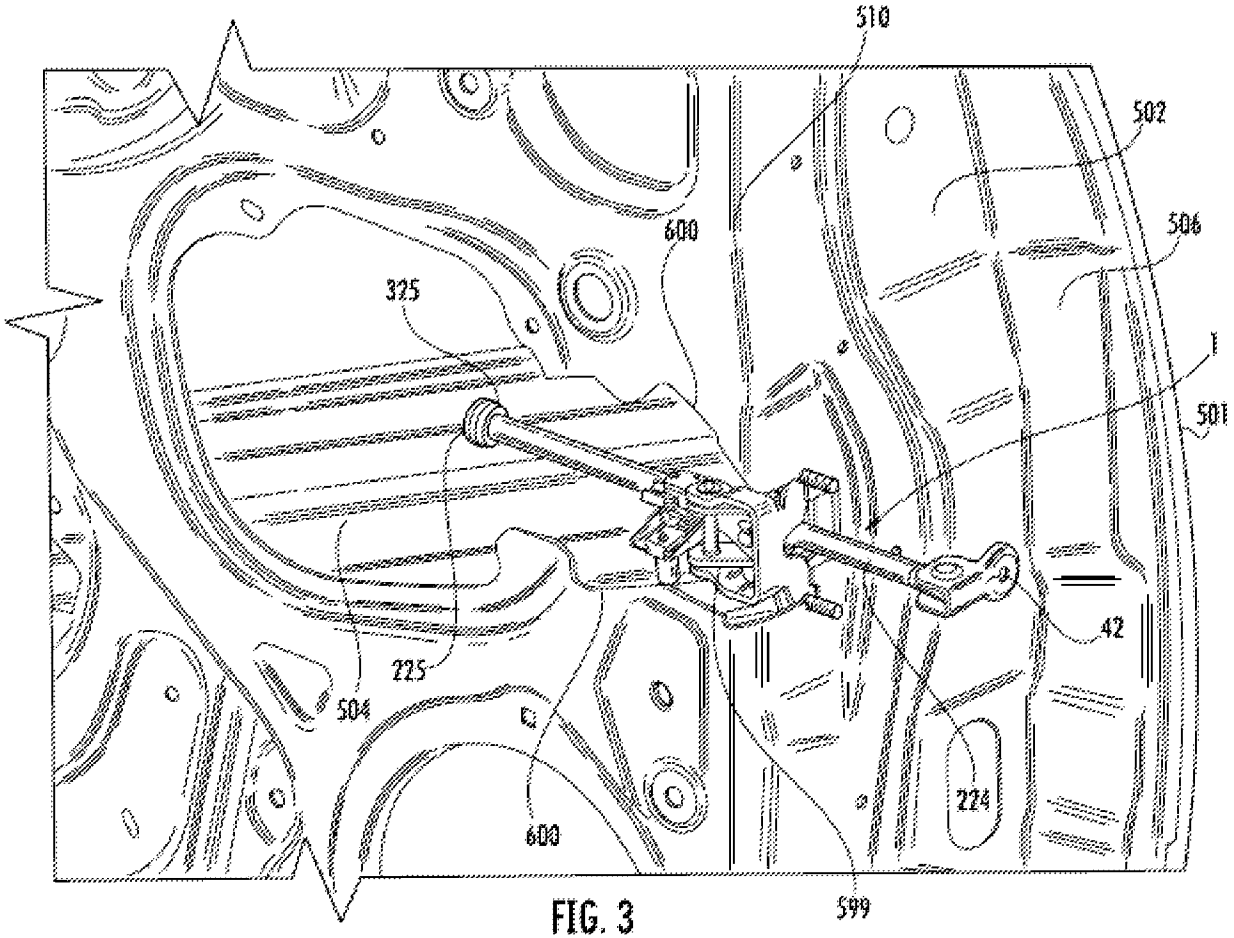
FIG. 3 is a close-up perspective drawing of the present invention, in situ, in a car door.
Figure 4:
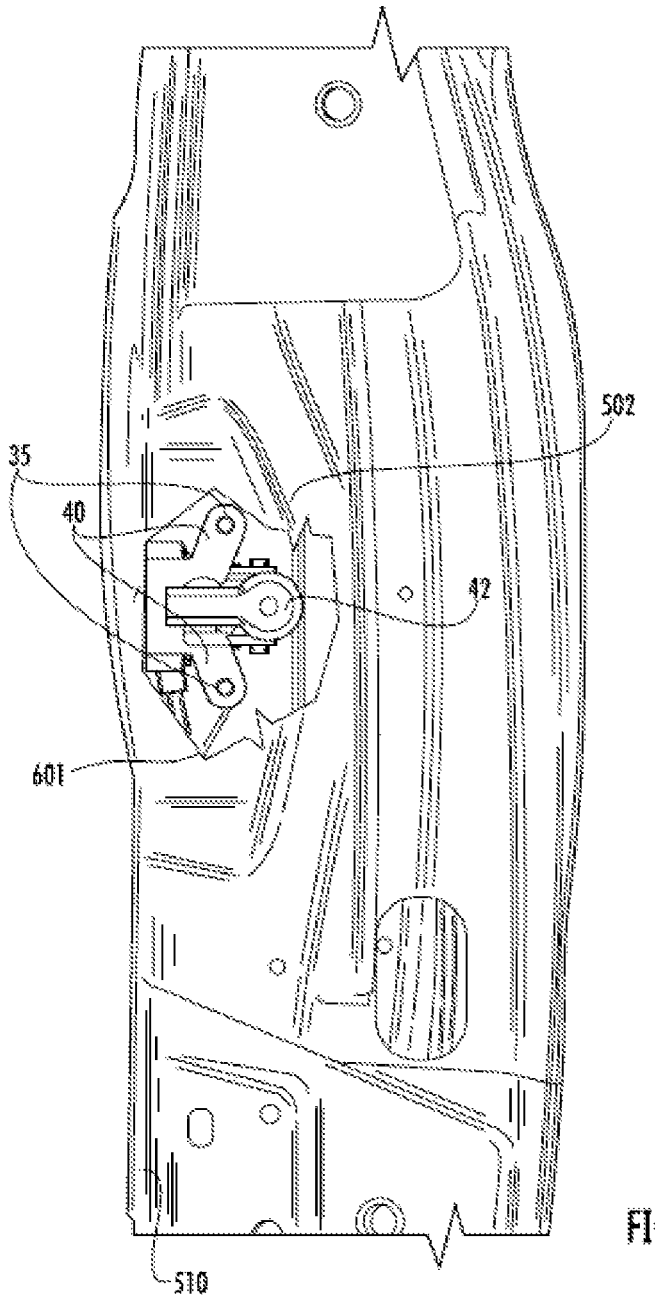
FIG. 4 is an end-view of the car door with the present invention, in situ.

FIGS. 2-4 show the present invention 1, in situ, being used as a positioner for a car door. In this application and embodiment, the positioner would prevent the door from moving outwards without the release lever being pulled, either inside or outside the car door. Such an application would prevent the door from moving, if the wind or gravity pulled the door out of the person's hand.

In FIG. 2, the present invention 1, a positioner mechanism using a linear adjusting lock 1, is installed on a car door shell 500. There is an inner sheet metal surface 503, hinge surface 502, an edge 510 between the inner surface 503 and the hinge surface 502, a plurality of cut-outs 505, a cross-member 504, an inner edge 501, and short surface 506. The hinge surface 502 is orthogonal to the inner sheet metal surface 503 and the short surface 506. The present invention is installed on the hinge surface 502 very near the edge 510. The re-positioning aggregation 599 and stopper 325 and washer 225 are inside the shell, as is a substantial portion of the rod 224, when the door in in the closed position. The rod anchor attachment ear 42 is attached to the car body. The mounting bracket 34 mounts the re-positioning aggregation 599 to the door shell 500. When the door shell 500 is fully opened, the stopper 325 hits the bushing 223 of the linear adjusting lock 800, stopping motion.

When the door is opened using either the interior or exterior handle (not shown), the actuator 100 attached to the handle pulls the inner cable 104, causing the release blade 46 to rotate. The coil spring 220 situated between the notched sleeve 221 and the notched bearing 218 has a tang 598 at either end. One tang 598 fits into the notch 596 of the notched sleeve 221 and the other tang 598 fits into the notch 597 of the notched bearing 218. When the release blade 46 rotates, it causes the coil spring 220 to uncoil slightly, increasing its inner diameter 595, so that the coil spring 220 inner diameter 595 is larger than the rod 224 outer diameter 594. When the coil spring 220 is slightly uncoiled, it releases the rod 224 allowing the rod 224 to slide through the re-positioning aggregation 599. When the door handle is released, the actuator 100 releases and the coil spring 220 recoils, grabbing the rod 224 and preventing it from moving relative to the re-positioning aggregation 599.

The present invention 1 has an over-ride mechanism to the linear adjusting lock 800. When pressure is put on the outside of the door shell 500, to close the door, it causes the upper pivot link 15 and the lower pivot link 26 to rotate slightly with respect to the linear adjusting lock 800. The engagement notch 416 of the upper pivot link 15 is in contact with the engagement tab 434 of the drive link 433. When the upper pivot link 15 pivots, the engagement notch 416 applies force to the engagement tab 434, rotating the drive link 433 around the pivot hole 33. The extension arm 32 rotates the blade 46 through an acute angle, releasing the coil spring 220 and allowing the rod 224 to slide through the re-positioning aggregation 599. In this way, pressure on the exterior of the car door, applied to close the car door, overcomes the linear adjusting lock 800, allowing the door to close.

The trunnions 45, 451 of the trunnion sleeve 450 is the axis of rotation about which the upper pivot link 15 and the lower pivot link 26 rotate. The lock rivet 20 keeps the upper pivot link 15 and the lower pivot link 26 in synch while rotating. The lock rivet 20, also, allows rotation of the upper pivot link 15 and the lower pivot link 26 in one direction and prevents rotation in the other direction, because of the engagement of the flattened surface 222 to the flattened feature 452 of the trunnion sleeve 450. In other applications, the linear adjusting lock, without an over-ride mechanism, can prevent motion in either direction without the use of the door handle.

FIG. 3 shows a close-up of the present invention 1 in situ in a door shell 500. A cut-away 600 shows the re-positioning aggregation 599, even though it would normally be behind the sheet metal surfaces 503, 502. The present invention 1 is very close to the edge 510 between the inner surface 503 and the hinge surface 502. For orientation, FIG. 3 shows the hinge surface 502, the edge 510, the cross-member 504, the inner edge 501, the short surface 506, the rod anchor attachment ear 42, the rod 224 and the washer 225.

FIG. 4 is an end view of the present invention 1 in the door shell 500. The mounting ears 40, fasteners 35, and rod anchor attachment ear 42 are visible through a cut-away 601.

Figure 16:
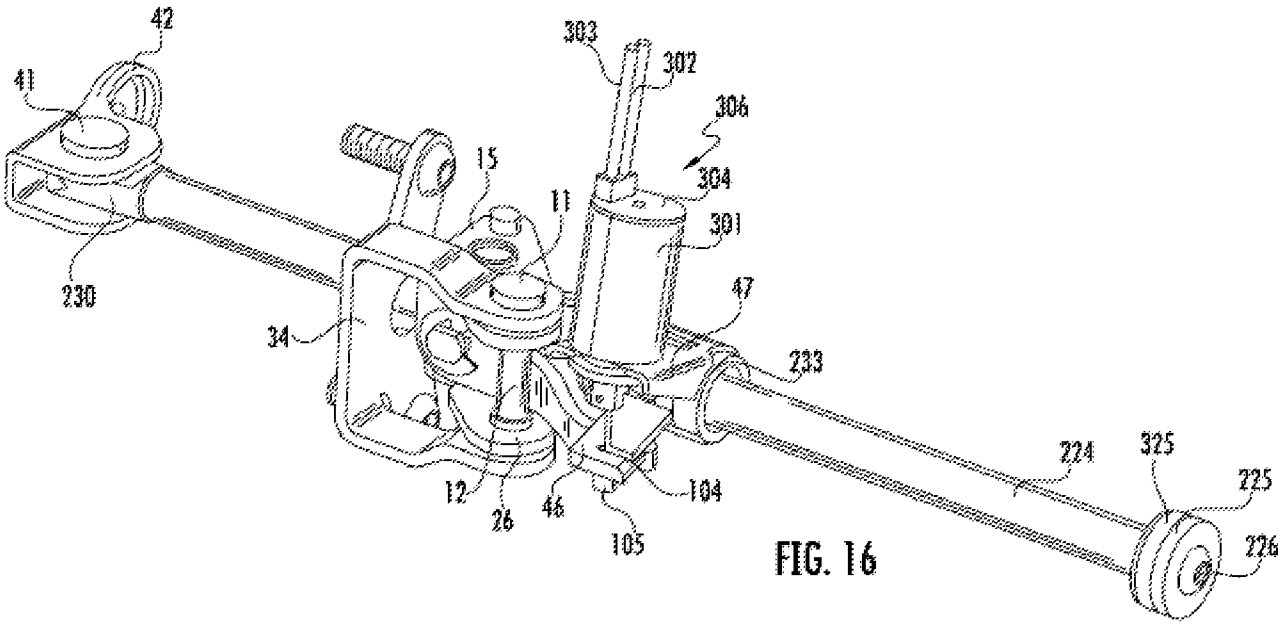
FIG. 16 is a perspective view of the present invention using an electronic actuator.
Figure 17:
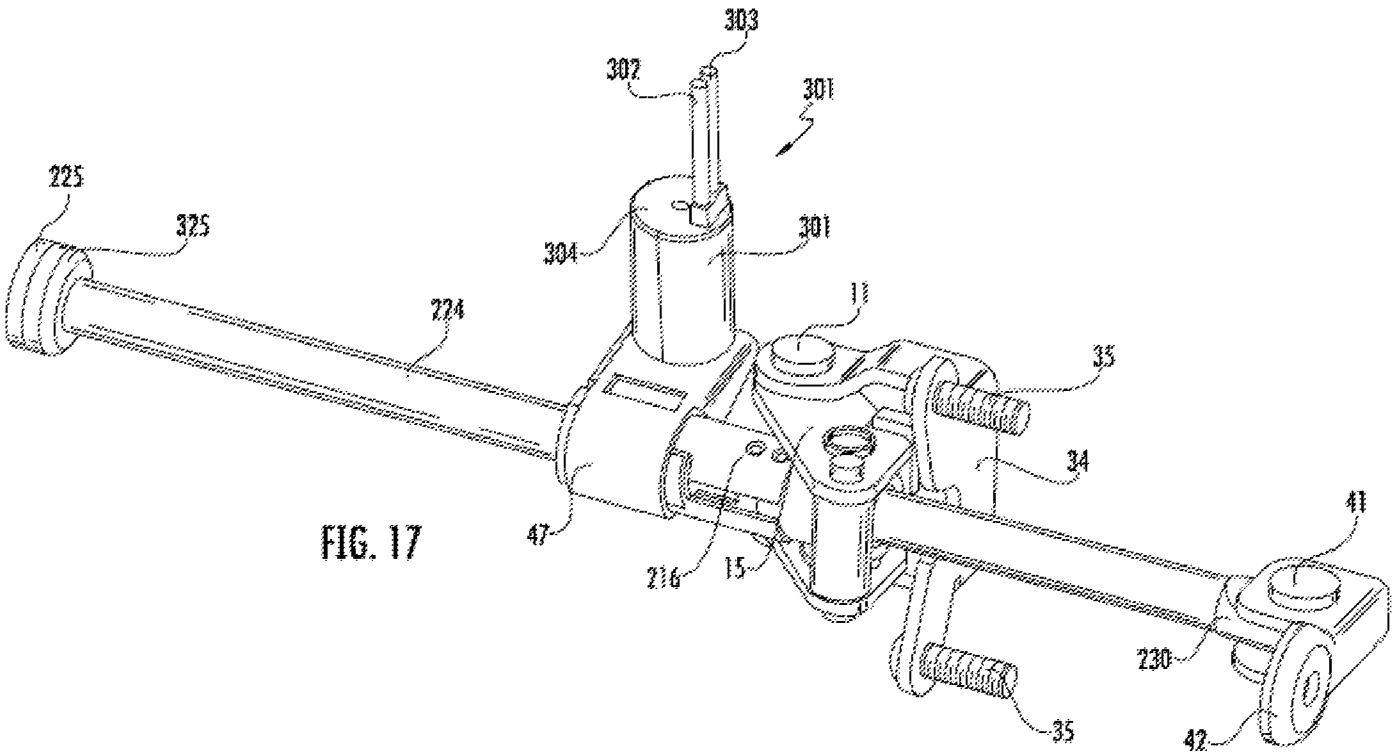
FIG. 17 is a perspective view of the present invention using an electronic actuator, rotated 180° with respect to FIG. 16.

FIGS. 16 and 17 show an alternative embodiment of the present invention 1 using an electronic actuator 306. This embodiment uses an electronic solenoid or electronic linear actuator 301 to retract the cable 104. The electronic solenoid or electronic linear actuator 301 is fed by two power wires 302, 303. The wires 302, 303 terminate on the top surface 304 of the electronic solenoid or electronic linear actuator 301, although the wires 302, 303 can conceivably terminate anywhere on the electronic solenoid or electronic linear actuator 301. The electronic solenoid or electronic linear actuator is fixed to the release anchor sleeve 47. Otherwise, the over-ride mechanism and the linear adjusting lock 800 work the same as the previously described embodiment.

We claim:

1. A positioning mechanism device to set a position between a first surface and a second surface comprising
- a linear adjusting lock comprised of
  - a rod with an outer diameter and anchor hole,
  - at least one coil spring with an inner diameter, and a tang at either end,
  - an annular, notched sleeve and a release blade, and
  - an annular notched bearing,
  - wherein one tang of at least one coil spring mates with the notch in the annular, notched sleeve, and wherein the other tang of at least one coil spring mates with the notch in the annular notched bearing;
  - wherein the inner diameter of the spring is smaller than the outer diameter of the rod, thereby locking the rod into position relative to the spring; and
  - wherein the release blade, when rotated through an acute angle, slightly uncoils the spring, unlocking the rod's relative position with respect to the spring;
- an actuator attached to the release blade; and
- an over-ride mechanism;
- wherein the rod anchor hole is attached to one of the two surfaces and the over-ride mechanism is attached to the other of the two surfaces;
- wherein, when activated, the actuator, independent of the over-ride mechanism, can rotate the release blade through an acute angle, unlocking the rod's relative position with respect to the spring; and
- wherein the over-ride mechanism, independent of the actuator, can rotate the release blade through an acute angle, unlocking the rod's relative position with respect to the spring.

2. The positioner mechanism device of claim 1, wherein the over-ride mechanism is comprised of
- an upper and lower pivot link,
- a pivot pin, having a head and a shank,
- a semi-cylindrical lock rivet possessing a flattened side, and a driven link;
- wherein each pivot link is planar, each pivot link contains at least three holes, and the upper pivot link has an edge notch;
- wherein the three holes of each pivot link are arranged so that there is a center hole and two outer holes on each pivot link, and wherein the edge notch of the upper pivot link is closer to one outer hole than the other outer hole; and
- wherein the driven link has a tab, a pivot hole, and an extension arm.

3. The positioner mechanism device of claim 2, wherein the over-ride mechanism is attached to the linear adjusting lock with an annular trunnion sleeve.

4. The positioner mechanism device of claim 3, wherein the annular trunnion sleeve has a cylindrical surface, at least three orthogonal trunnions, and a flattened feature extending from the cylindrical surface.

5. The positioner mechanism device of claim 4, further comprising a mounting bracket to mount the over-ride mechanism to a surface.

6. The positioner mechanism device of claim 5, wherein the mounting bracket is comprised of
- at least two mounting tabs,
- an upper pivot ear, and
- a lower pivot ear;
- wherein each tab and each pivot ear has a hole.

7. The positioner mechanism device of claim 6, wherein, in order, the pivot pin passes through,
- the hole in the upper pivot ear of the mounting bracket,
- the outer hole of the upper pivot link that is closest to the edge notch,
- an outer hole of the lower pivot link,
- and the hole in the lower pivot ear of the mounting bracket.

8. The positioner mechanism device of claim 7, wherein
- a first trunnion of the trunnion sleeve fits through the center hole of the upper pivot link,
- a second trunnion of the trunnion sleeve, disposed radially about the cylindrical surface of the trunnion sleeve 180° from the first trunnion, fits through the center hole of the lower pivot link, and
- a third trunnion of the trunnion sleeve, disposed radially about the cylindrical surface of the trunnion sleeve 90° from both the first and second trunnions, fits through the pivot hole of the driven link.

9. The positioner mechanism of claim 8, wherein
- the flattened feature of the trunnion sleeve is disposed, radially, 90° from both the first trunnion and second trunnion, and 180° from the third trunnion;
- the lock rivet inserts through an outer hole of the upper pivot link and an outer hole of the lower pivot link, and
- the flattened side of the lock rivet faces the flattened feature of the trunnion sleeve.

10. The positioner mechanism device of claim 9, wherein, when activated, the actuator allows the second surface to be re-positioned relative to the first surface.

11. The positioner mechanism device of claim 10, wherein the actuator is an electrical actuator.

12. The positioner mechanism device of claim 10, wherein the actuator is a mechanical actuator.

13. The positioner mechanism device of claim 11, wherein the rod anchor hole is attached to the first surface and the mounting bracket of the over-ride mechanism is attached to the second surface;

wherein a compressive force pushing the second surface towards the first surface causes the over-ride mechanism to activate by rotating the upper and lower pivot link about their respective trunnions, causing the notched edge to apply a force to the driven link tab, causing the driven link to rotate about the pivot hole, forcing the extension arm of the driven link to rotate the release blade through an acute angle, releasing the linear adjusting lock; and wherein a tensile force pulling the second surface away from the first surface causes the flattened side of the lock rivet to interact with the flattened feature of the trunnion sleeve, preventing the over-ride mechanism from moving, allowing the linear adjusting lock to remain locked.

14. The positioner mechanism device of claim 11, wherein the rod anchor hole is attached to the first surface and the mounting bracket of the over-ride mechanism is attached to the second surface;

wherein a tensile force pulling the second surface away from the first surface causes the over-ride mechanism to activate by rotating the upper and lower pivot link about their respective trunnions, causing the notched edge to apply a force to the driven link tab, causing the driven link to rotate about the pivot hole, forcing the extension arm of the driven link to rotate the release blade through an acute angle, releasing the linear adjusting lock; and wherein a compressive force pushing the second surface towards the first surface causes the flattened side of the lock rivet to interact with the flattened feature of the trunnion sleeve, preventing the over-ride mechanism from moving, allowing the linear adjusting lock to remain locked.

15. The positioner mechanism device of claim 11, wherein the rod anchor hole is attached to the second surface and the mounting bracket of the over-ride mechanism is attached to the first surface;

wherein a compressive force pushing the second surface towards the first surface causes the over-ride mechanism to activate by rotating the upper and lower pivot link about their respective trunnions, causing the notched edge to apply a force to the driven link tab, causing the driven link to rotate about the pivot hole, causing the extension arm of the driven link to rotate the release blade through an acute angle, releasing the linear adjusting lock; and wherein a tensile force pulling the second surface away from the first surface causes the flattened side of the lock rivet to interact with the flattened feature of the trunnion sleeve, preventing the over-ride mechanism from moving, allowing the linear adjusting lock to remain locked.

16. The positioner mechanism device of claim 11, wherein the rod anchor hole is attached to the second surface and the mounting bracket of the over-ride mechanism is attached to the first surface;

wherein a tensile force pulling the second surface away from the first surface causes the over-ride mechanism to activate by rotating the upper and lower pivot link about their respective trunnions, causing the notched edge to apply a force to the driven link tab, causing the driven link to rotate about the pivot hole, forcing the extension arm of the driven link to rotate the release blade through an acute angle, releasing the linear adjusting lock; and wherein a compressive force pushing the second surface towards the first surface causes the flattened side of the lock rivet to interact with the flattened feature of the trunnion sleeve, preventing the over-ride mechanism from moving, allowing the linear adjusting lock to remain locked.

17. The positioner mechanism device of claim 12, wherein the rod anchor hole is attached to the first surface and the mounting bracket of the over-ride mechanism is attached to the second surface;

wherein a compressive force pushing the second surface towards the first surface causes the over-ride mechanism to activate by rotating the upper and lower pivot link about their respective trunnions, causing the notched edge to apply a force to the driven link tab, causing the driven link to rotate about the pivot hole, causing the extension arm of the driven link to rotate the release blade through an acute angle, releasing the linear adjusting lock; and wherein a tensile force pulling the second surface away from the first surface causes the flattened side of the lock rivet to interact with the flattened feature of the trunnion sleeve, preventing the over-ride mechanism from moving, allowing the linear adjusting lock to remain locked.

18. The positioner mechanism device of claim 12, wherein the rod anchor hole is attached to the first surface and the mounting bracket of the over-ride mechanism is attached to the second surface;

wherein a tensile force pulling the second surface away from the first surface causes the over-ride mechanism to activate by rotating the upper and lower pivot link about their respective trunnions, causing the notched edge to apply a force to the driven link tab, causing the driven link to rotate about the pivot hole, causing the extension arm of the driven link to rotate the release blade through an acute angle, releasing the linear adjusting lock; and wherein a compressive force pushing the second surface towards the first surface causes the flattened side of the lock rivet to interact with the flattened feature of the trunnion sleeve, preventing the over-ride mechanism from moving, allowing the linear adjusting lock to remain locked.

19. The positioner mechanism device of claim 12, wherein the rod anchor hole is attached to the second surface and the mounting bracket of the over-ride mechanism is attached to the first surface;

wherein a compressive force pushing the second surface towards the first surface causes the over-ride mechanism to activate by rotating the upper and lower pivot link about their respective trunnions, causing the notched edge to apply a force to the driven link tab, causing the driven link to rotate about the pivot hole, causing the extension arm of the driven link to rotate the release blade through an acute angle, releasing the linear adjusting lock; and wherein a tensile force pulling the second surface away from the first surface causes the flattened side of the lock rivet to interact with the flattened feature of the trunnion sleeve, preventing the over-ride mechanism from moving, allowing the linear adjusting lock to remain locked.

20. The positioner mechanism device of claim 12, wherein the rod anchor hole is attached to the second surface and the mounting bracket of the over-ride mechanism is attached to the first surface;

wherein a tensile force pulling the second surface away from the first surface causes the over-ride mechanism to activate by rotating the upper and lower pivot link about their respective trunnions, causing the notched edge to apply a force to the driven link tab, causing the driven link to rotate about the pivot hole, causing the extension arm of the driven link to rotate the release blade through an acute angle, releasing the linear adjusting lock; and wherein a compressive force pushing the second surface towards the first surface causes the flattened side of the lock rivet to interact with the flattened feature of the trunnion sleeve, preventing the over-ride mechanism from moving, allowing the linear adjusting lock to remain locked.

* * * * *